US009689329B2

(12) United States Patent
Remele et al.

(10) Patent No.: US 9,689,329 B2
(45) Date of Patent: Jun. 27, 2017

(54) METHOD FOR FAILURE DETECTION OF INJECTORS IN AN INTERNAL COMBUSTION ENGINE, CONTROL UNIT AND SYSTEM FOR CARRYING OUT A METHOD

(71) Applicant: MTU Friedrichshafen GmbH, Friedrichshafen (DE)

(72) Inventors: Jörg Remele, Hagnau (DE); Aron Toth, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 290 days.

(21) Appl. No.: 14/683,640

(22) Filed: Apr. 10, 2015

(65) Prior Publication Data

US 2015/0211425 A1 Jul. 30, 2015

Related U.S. Application Data

(63) Continuation of application No. PCT/EP2013/002993, filed on Oct. 4, 2013.

(30) Foreign Application Priority Data

Oct. 10, 2012 (DE) ..... 10 2012 020 490

(51) Int. Cl.
*F02D 41/00* (2006.01)
*F02D 41/22* (2006.01)
(Continued)

(52) U.S. Cl.
CPC ..... *F02D 41/009* (2013.01); *F02D 17/04* (2013.01); *F02D 41/0087* (2013.01);
(Continued)

(58) Field of Classification Search
CPC .. F02D 41/009; F02D 17/04; F02D 2041/224; F02D 41/22; F02D 41/3005; F02D 2041/288; F02D 41/2467; F02M 65/00
See application file for complete search history.

(56) References Cited

U.S. PATENT DOCUMENTS 5,303,158 A * 4/1994 Kuroda ..... G01M 15/11 123/354
5,404,750 A * 4/1995 Denz ..... F02D 41/221 73/114.45
6,021,758 A * 2/2000 Carey ..... F02D 41/0085 123/406.24
6,820,593 B2 * 11/2004 Remele ..... F02D 41/0085 123/436
(Continued)

FOREIGN PATENT DOCUMENTS

DE 196 26 690 A1 1/1998
DE 10 2008 032 174 A1 7/2009
WO 2008/140404 A1 11/2008

OTHER PUBLICATIONS

International Search Report dated Feb. 13, 2014 for International Application No. PCT/EP2013/002993 (6 pages).

*Primary Examiner* — Freddie Kirkland, III
(74) *Attorney, Agent, or Firm* — Taylor IP, P.C.

(57) ABSTRACT

The invention relates to a method for detecting the failure of injectors in an internal combustion engine, comprising the following steps: measuring a crank angle signal; transforming the crank angle signal into the frequency range by means of a discrete Fourier transformation; switching off each injector once and in a sequential manner; detecting and storing an angle of the harmonic of the 0.5th order of the Fourier-transformed crank angle signal for each switched-off injector once and in a sequential manner; continuous detection and storage of an angle and an amount of the harmonic of the 0.5th order of the Fourier-transformed crank angle signal; continuous comparison of the continuously detected amount with a predetermined threshold value, and determining a failure of the injector when the amount exceeds the predetermined threshold value; comparing the continuously detected angle with the angles stored for each switched-off injector when a failure of the injector is detected, and identifying the failed injector with an injector, for which a matching, stored angle is found.

10 Claims, 1 Drawing Sheet

(51) Int. Cl.

| | |
|---|---|
| ***F02D 41/24*** | (2006.01) |
| ***F02D 41/30*** | (2006.01) |
| ***F02D 17/04*** | (2006.01) |
| ***F02M 65/00*** | (2006.01) |
| *F02D 41/28* | (2006.01) |

(52) U.S. Cl.
CPC ..... *F02D 41/22* (2013.01); *F02D 41/221* (2013.01); *F02D 41/2451* (2013.01); *F02D 41/3005* (2013.01); *F02M 65/00* (2013.01); *F02D 2041/224* (2013.01); *F02D 2041/288* (2013.01)

(56) References Cited

U.S. PATENT DOCUMENTS

| | | | | |
|---|---|---|---|---|
| 7,219,003 | B2 * | 5/2007 | Hagel | F02D 41/1498 123/436 |
| 8,200,415 | B2 * | 6/2012 | Hagel | F02D 41/0087 123/435 |
| 8,626,372 | B2 * | 1/2014 | Kumar | F02D 41/0097 123/406.24 |
| 8,756,984 | B2 * | 6/2014 | Majima | G01M 15/11 73/114.11 |
| 9,200,981 | B2 * | 12/2015 | Horlbeck | F02D 41/1497 |
| 2005/0229904 | A1 * | 10/2005 | Hagel | F02D 41/1498 123/436 |
| 2010/0063711 | A1 * | 3/2010 | Hagel | F02D 41/0087 701/111 |
| 2015/0211430 | A1 * | 7/2015 | Remele | F02D 41/0085 123/480 |

* cited by examiner

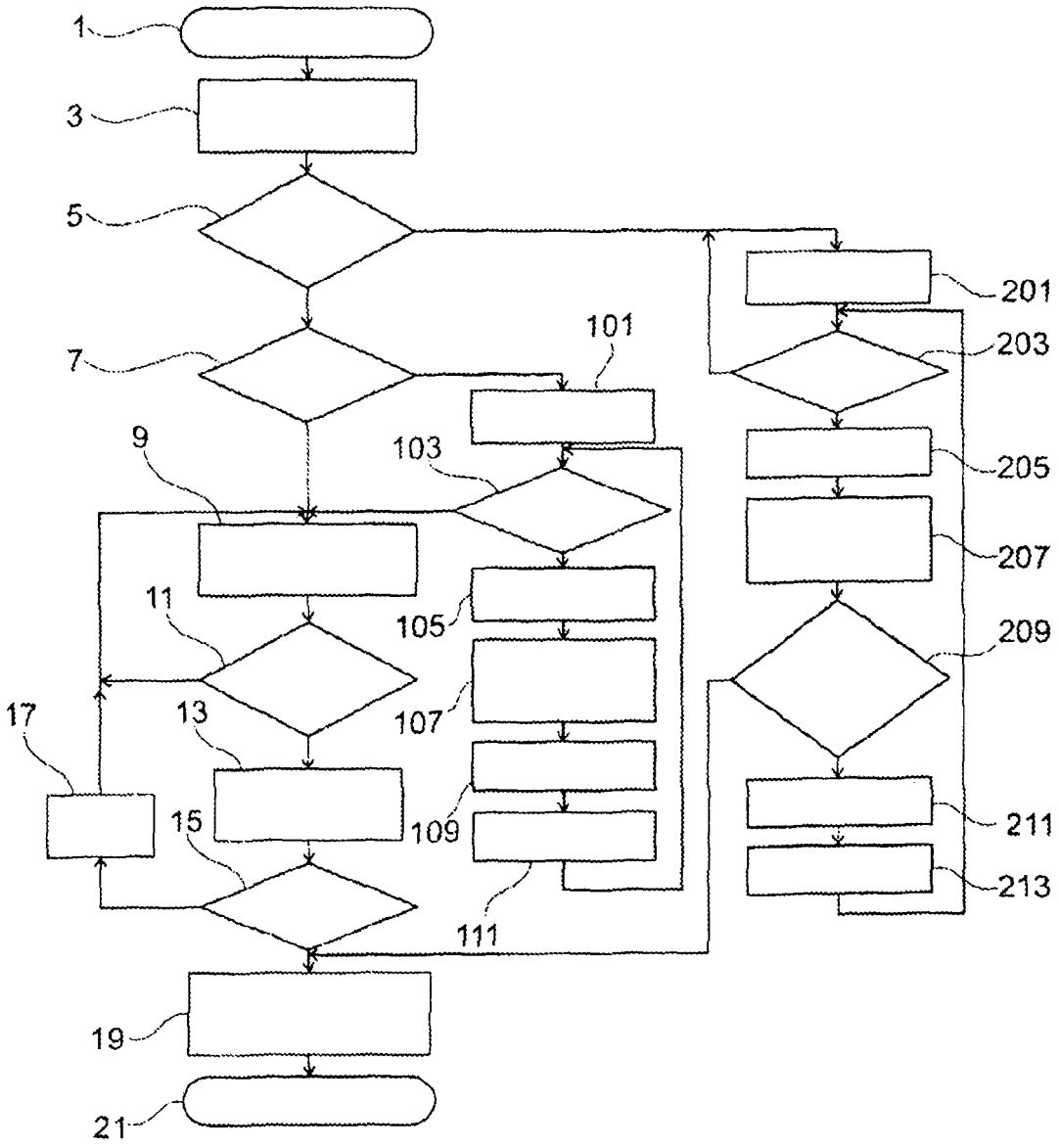
1
3
5
7
9
11
13
15
17
19
21
101
103
105
107
109
111
201
203
205
207
209
211
213

METHOD FOR FAILURE DETECTION OF INJECTORS IN AN INTERNAL COMBUSTION ENGINE, CONTROL UNIT AND SYSTEM FOR CARRYING OUT A METHOD

CROSS REFERENCE TO RELATED APPLICATIONS

This is a continuation of PCT application No. PCT/EP2013/002993, entitled "METHOD FOR FAILURE DETECTION OF INJECTORS IN AN INTERNAL COMBUSTION ENGINE, CONTROL UNIT AND SYSTEM FOR CARRYING OUT A METHOD", filed Oct. 4, 2013, which is incorporated herein by reference.

BACKGROUND OF THE INVENTION

1. Field of the Invention

The invention relates to a method for detecting failure of injectors in an internal combustion engine, an engine control unit for an internal combustion engine as well as a system to carry out the method for failure detection.

2. Description of the Related Art

Methods for detecting failure of fuel injectors are known in the prior art. One such method is known from U.S. Pat. No. 5,303,158 A for recognition of abnormal combustion events in cylinders of an internal combustion engine, whereby a failed injector can be determined from an anomalous combustion event. Within the scope of the known method a speed signal of the internal combustion engine is Fourier-transformed and amplitudes within predetermined frequency ranges of the thus obtained spectra are compared in order to detect an anomalous combustion event. If such an event is detected, the method uses separate process steps to find out in which cylinder the anomalous combustion is occurring. For this purpose an anomalous combustion is forced respectively in the individual cylinders and amplitudes in predetermined frequency ranges of the thus obtained spectra are again compared with each other, whereby the results of the comparison are compared with corresponding results from the spectra received previously without forced anomalous combustion. This demonstrates that the method is complicated and cumbersome, in particular because after recognition of an anomalous combustion, such forced anomalous combustion must be forced sequentially in each cylinder, so that it can be determined in which cylinder the anomalous combustion event is occurring. The comparison of the amplitudes in predefined frequency ranges of the various spectra is also expensive and cumbersome.

What is needed in the art is a method with which injector failure can be simply and quickly detected and a failed injector identified during normal operation of the engine. An engine control unit which is designed to perform the method is also needed, as well as a system with the help of which the method can be implemented.

SUMMARY OF THE INVENTION

The present invention provides such a method for simple and quick identification of a failed injector. The method for failure detection of injectors in an internal combustion engine includes a number of steps. First, a crank angle signal is measured and then transformed into the frequency range by way of discrete Fourier-transformation. From the discrete Fourier-transformation of the crank angle signal an amount and an angle result in particular for a harmonic of the 0.5th order of the crank angle signal in the frequency range. The individual injectors are turned off once per injector, sequentially one after the other. An angle of the harmonic of the 0.5th order of the Fourier-transformed crank angle signal is also determined once per injector, sequentially for each turned off injector. For example, a first injector is initially turned off and an angle of the harmonic of the 0.5th order for this operational state of the internal combustion engine is captured for this individually turned off first injector, and may be stored in a first memory device. Then the first injector is turned on again and a second injector is turned off while the remaining injectors remain turned on. A pertinent angle is captured also for this operational state and stored in the first memory device. This is continued until for each individual turned off injector, an appropriate value has been captured and stored in the first memory device. The angles in the first memory device are thereby assigned to the respective injectors.

During the operation of the internal combustion engine and/or during performance of the method an angle and an amount of the harmonic of the 0.5th order of the Fourier-transformed crank angle signal is continuously captured and stored, possibly in a second memory device. The thus continuously captured amount is continuously compared with a predefined threshold value. An injector failure is detected if the continuously captured amount exceeds the predefined threshold value. For this it is essential that, in the event that all injectors of the internal combustion engine are operative, the amount of the harmonic of the 0.5th order should disappear or at least be small. In contrast, failure of an injector leads to increase of the amount of the harmonic of the 0.5th order. It is therefore possible to establish a threshold value that, when exceeded in all likelihood an injector failure will occur. The increased amount is merely an indicator that an injector failed. In contrast, the angle of the harmonic of the 0.5th order indicates which individual injector actually failed. In the process step discussed here it is therefore first determined whether an injector failed at all.

In an additional process step the continuously captured angle is compared individually with the angles that are stored for each of the turned off injectors in the first memory device if an injector failure was previously detected due to the increased amount. The failed injector is then identified with the injector for which during the comparison a conforming angle was found stored in the first memory device. In this way it can easily be determined which injector has failed if an injector failure has been detected.

Here it is evident that it is not necessary within the scope of the method to tediously compare amplitudes of spectra measured in various spectral ranges. Moreover it is not necessary after detection of an injector failure to turn off the individual injectors of the cylinder one after another. Rather it is sufficient to turn off the injectors once sequentially and to store the assigned angles. In running operation of the internal combustion engine it can easily be concluded which specific injector has failed by comparing an actual angle captured during a detected injector failure with the stored values.

It is possible that the second memory device only shows one memory region for a just captured angle, so that the next captured angle overwrites the last captured angle. In this case the angle is kept in the memory region when an injector failure is detected, whereby this occurs at least until the failed injector has been identified. It is also possible that the second memory device includes several memory regions, which are continuously being filled, whereby the oldest value is always removed from its memory region when a new value is stored. It is then possible to continuously capture additional angles and amounts already during a comparison for identification of a failed injector. It is then of course necessary to keep precise records on the current memory region of the angle that has just been included into the comparison, since this preferably changes with each newly added angle, until the angle finally drops out of the last used memory region.

For comparison of the angles it is possible to specify a tolerance range or error range within which the angles that were compared with each other have to correspond so that a failed injector can be identified. It is therefore not absolutely necessary that the compared values correspond exactly. When determining the tolerance, or respectively the error range, measurement errors that are to be expected, statistical fluctuations, as well as artifacts of the discrete Fourier transformation are preferably considered.

A method is provided wherein the angles captured once in a sequential manner are stored in a so-called lookup-table. The first memory device may therefore include a tabular memory region where the values that are stored are assigned to the respectively turned off injectors.

A method is also provided in which the one-time sequential capture and storage of the angles for each turned off injector is performed after a start of the internal combustion engine or after a start of the process. It is performed in particular immediately after the start of the internal combustion engine or immediately after the start of the process, so that the first memory device, which may be the look-up table, is filled with values as soon as the internal combustion engine is started up or the process is started. In this respect the first memory device or respectively the method is hereby initialized and subsequent monitoring of the internal combustion engine in regard to failed injectors can occur during normal operation without it becoming necessary again during further progression of the operation to turn off individual injectors in a targeted manner. The initialization of the first memory device therefore occurs preferably at a point in time where the internal combustion engine is not yet under a normal load, so that targeted turning off of individual injectors does not disturb the later normal operation. In this context it is possible that the method is started immediately at the start of the internal combustion engine. Moreover, the method may be performed during the entire operation of the internal combustion engine, whereby initially after the start of the internal combustion engine the first memory region is initialized once, and whereby the method subsequently runs in the background without further intervention into the operation of the internal combustion engine in order to monitor the internal combustion engine in regard to injector failure. The method causes no control intervention into the operation of the internal combustion engine, as long as no injector failure is detected. If an injector failure is detected no intervention into the operation of the internal combustion engine is necessary, as already discussed, in order to identify the failed injector.

In an alternative embodiment of the method it is possible that the method is started independent of the start of the internal combustion engine at a discretionary point in time, for example by being deliberately initiated by the operator or driver. It is also possible that the method is concluded, possibly through intervention by the driver or operator of the internal combustion engine. In this case however, operating times of the internal combustion engine result during which a failed injector cannot be detected and identified, namely when the method is not performed.

A method is also provided, in which at least one action is taken when an injector failure is detected and a failed detector is identified. It is thereby possible that the action is in the form of a warning message being provided to a driver or operator of the internal combustion engine. Alternatively or in addition it is possible that energizing of the failed injector is interrupted. It is then especially advantageous if the injector does not fail due to erroneous energizing, but rather for example due to a mechanical problem. Disabling the defective injector prevents further damage due to being energized. Obviously, it is possible that, for example a short circuit causes injector failure whereby it is advantageous to interrupt energizing of the defective injector. Alternatively or in addition it is possible to reduce a performance of the internal combustion engine. Damage or even destruction of the internal combustion engine and/or clutch which could possibly occur if the internal combustion engine continues to be operated at full performance in spite of the failed injector, can hereby be prevented. Alternatively or in addition it is also possible to turn off the internal combustion engine. This is preferred especially if otherwise damage to the internal combustion engine and/or the clutch is to be feared.

A method is moreover provided which includes the following additional steps: The continuously captured angle and amount of the harmonic of the 0.5th order of the crank angle signal is initially stored when an initial injector failure is recognized, before the angle for each turned off injector is captured and stored once in a sequential manner. In particular it is verified immediately after a start of the internal combustion engine whether an injector failure is already being detected, that is whether a captured amount of the harmonic of the 0.5th order exceeds the predetermined threshold value. If this is the case, the captured angle, as well as the amount are stored, possibly in a third memory device In this case, no angles for comparison are yet available in the first memory device, because the injector failure was detected prior to initialization of the first memory device.

In this case, the individual injectors are turned off sequentially one after the other after capture and initial storing of the angle and the amount, whereby for each individual turned off injector an amount and an angle of the harmonic of the 0.5th order of the crank angle signal is captured and compared with the initially stored values which are available possibly in the third memory device. An initially failed injector, that is an injector which failed already prior to initialization of the first memory device is thereby identified if the values of amount and angle captured for an individual turned off injector correspond with the initially stored values.

This approach is based on the consideration that neither the angle nor the amount of the harmonic of the 0.5th order change when the failed injector is turned off. Therefore, the current captured values should in this case be identical with the initially stored values. If in contrast a functional injector is turned off, deviating values result for the angle as well as also for the amount of the harmonic of the 0.5th order. Overall it is thus possible to identify the initially failed injector even before initialization of the first memory device.

In this context a method is provided, in which one of the previously described steps are taken when an initially failed injector is identified. Also in this case a warning message may be provided to a driver or operator, energizing of the failed injector is interrupted, performance of the internal combustion engine is reduced and/or the internal combustion engine is shut off. This makes it possible in particular to prevent damage to and/or destruction of the internal combustion engine.

A method is also provided that it is performed in an engine control unit which also assumes control of the internal combustion engine. The engine control unit may be a so-called electronic engine control unit (ECU). The crank angle signal may be captured by the crank shaft sensor which is otherwise provided for engine control. The engine control unit is synchronized to the work cycles of cylinders of the internal combustion engine, possibly at the beginning of the method or at a start of the internal combustion engine by way of a cam shaft signal which may be captured by a cam shaft sensor. This synchronization commonly occurs in engine controls, so that the engine control unit can also observe other functions for control of the internal combustion engine. Thus, the method does not require additional devices which are not otherwise provided in or on the internal combustion engine. The method requires in particular only signals from the crank shaft and the cam shaft. Since these signals are captured on all modern internal combustion engines, no additional sensor, unit and/or wiring costs occur. Since the algorithm for the method may be implemented into the engine control unit no additional costs arise here either, or in other words, no additional devices need to be connected to the internal combustion engine.

A method is also provided in which the method is performed at one operating point of the internal combustion engine under load or no-load. Basically, it is possible that the method may be performed under load as well as under no-load of the internal combustion engine, thus taking place during its entire operation. The method may be implemented in large engines, for example as drive units for locomotives, ships, other large vehicles, or also as stationary units, for example for small power plants. With such large engines normally no thrust phase occurs as is common with smaller engines in motor vehicles, which occurs when a vehicle rolls with engaged clutch without application of the gas pedal and drags the internal combustion engine along. Numerous methods make use of this thrust phase, in order to identify the existence of an injector failure or respectively to identify a particular failed injector. Such methods cannot be utilized on large engines since these generally do not have a thrust phase. Therefore, this method is especially suitable for implementation with large engines, because it can be performed independently from an operating point of the internal combustion engine, specifically but under load or no-load.

The invention provides an engine control unit for an internal combustion engine set up for implementation of a method according to one of the previously described embodiments. In particular, an appropriate algorithm is implemented into the engine control unit. The invention also provides a system for implementation of a method according to one of the previously described embodiments with the characteristics of claim 10 is created. The system includes a detection device, possibly a crankshaft sensor which is designed so that it can measure or respectively capture a crank angle signal. It includes a converter which is operatively connected with the detection device for the purpose of transmitting the crank angle signal and is designed such that the crank angle signal can be converted with the assistance of the converter into the frequency range by way of discrete Fourier transformation. The system moreover includes a switching device which is designed so that with its assistance injectors of the internal combustion engine can be turned off sequentially and in particular individually, and turned on again. The system also includes a first memory device which is designed so that with its assistance an angle of the harmonic of the 0.5th order of the crank angle signal for each individually turned off injector can be captured and stored.

A second memory device is provided which is designed so that it can continuously capture and store an angle and an amount of the harmonic of the 0.5th order of the crank angle signal. Moreover, first comparison device is provided which is designed with the ability to continuously compare the amount stored in the second memory device with a predetermined threshold value, wherein the comparison device is also designed so that it detects an injector failure when the amount exceeds the predetermined threshold value. A second comparison device is provided which is designed so that it can compare the angle stored in the second memory device individually with each of the angles stored in the first memory device when an injector failure occurs. The second comparison device is moreover designed so that it identifies a failed injector with the injector for which, possibly within the scope of a predetermined tolerance and/or error range, a conforming angle stored in the first memory device is found. Otherwise, the system implements the method as described in one of the previously described embodiments.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein:

The FIGURE shows a flow diagram of one embodiment of the method.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Turning now to the FIGURE, in a first step 1 the method for failure recognition of injectors is initiated. This may occur together with or immediately after the start of the internal combustion engine. In a second step 3 an amount and an angle of a harmonic of the 0.5th order of a crank angle signal that was transformed by way of discrete Fourier transformation into the frequency range are captured and possibly stored in a third memory device. A retrieval step 5 follows, which verifies if the amount initially stored in step 3 is greater than a predetermined threshold value.

If this is not the case, then there is clearly no initially failed injector and the method proceeds further to retrieval step 7. Here it is verified if a first memory device has already been initialized. The first memory device may be newly initialized after each new start of the internal combustion engine. It is, however, not absolutely necessary to re-initialize the first memory device if the method is halted during running operation of the internal combustion engine and, after a certain waiting period, is started again. But, it is certainly possible to re-initialize the first memory device, whereby it can also be erased at the end of the process, so that it must be newly initialized upon restart of the engine. In an alternative embodiment it is of course also possible that the memory device is not re-initialized after each new start of the internal combustion engine, but that the values filed in particular in the lookup-table are used for a predetermined number of uses of the internal combustion engine. If the first memory device is not yet initialized the method proceeds to step 101. Otherwise, if an initialized first storage device or respectively a look-up table that is filled with data is already available, the method proceeds to a step 9.

Initialization of the first memory device and/or assignment of data to the look-up table is described next. For this purpose a number of cylinders of the internal combustion engine and thereby also the number of injectors of the internal combustion engine is first determined in step 101. In one embodiment of the method the internal combustion engine includes exactly one injector per cylinder. It is however also possible that more than one injector per cylinder can be provided. The method described below is then modified accordingly. For the sake of simplicity, only the arrangement wherein the internal combustion engine only includes one injector per cylinder is described here. The determined number of cylinders is stored and a running variable is set to value 0.

Afterwards it is verified in retrieval step 103 whether the current value of the running variable is less than the stored number of cylinders. If this is the case, the method proceeds to a step 105, in which a first injector is turned off if the running variable shows a value of 0, in which a second injector is turned off if the running variable shows a value of 1, and so on. Thus always one and only one injector that is clearly assigned to the current value of the running variable is turned off. In a subsequent step 107 an angle of the harmonic of the 0.5th order is captured and filed in the first memory device or respectively the look-up table, and is assigned to the only turned off injector according to the current value of the running variable. In a following step 109 the relevant injector that is assigned to the current value of the running variable is turned on again.

In a subsequent step 111 the value of the running variable is increased by an amount of 1. The process returns to retrieval step 103 where it is again verified whether the new value of the running variable is still less than the stored number of cylinders. If this is still the case, the sequence of steps 105 to 111 is repeated. In other words, a loop around retrieval step 103 and steps 105 to 111 is cycled until for each individually turned off injector an angle of the harmonic of the 0.5th order has been captured and stored. The first time the running variable shows a value which is consistent with the number of cylinders, the appropriate loop for all injectors will have been cycled, the first loop having started for the first injector with value 0 for the running variable. Therefore, the loop will have occurred for the last injector when the running variable shows a value that is consistent with the number of cylinders, reduced by 1.

If, therefore the running variable shows a value for the first time in retrieval step 103 that is identical to the number of cylinders, the method proceeds to step 9. As already explained, the method also proceeds directly from retrieval step 7 to step 9 if initialization of the first memory device, or respectively placement of data in the look-up table can be foregone. In step 9 an amount as well as an angle of the harmonic of the 0.5th order of the Fourier transformed crank angle signal is captured and may be stored in a second memory device. In retrieval step 11 it is verified if the amount captured and stored in step 9 is greater than the predetermined threshold value. If this is not the case then there is clearly no injector failure and the process returns to step 9, where again an amount and an angle of the harmonic of the 0.5th order is captured and stored. Thereby it becomes clear that no loop occurs here, wherein an amount and an angle of the harmonic of the 0.5th order is continuously captured and stored. This is continued until it is determined in retrieval step 11 that the current captured and stored value is greater than the predetermined threshold value. In this case there is an injector failure and the method proceeds to step 13, where the angle captured in step 9 is compared individually with the angles stored in the first memory device or respectively the lookup-table that are respectively assigned to individually turned off injectors.

In retrieval step 15 it is finally verified whether, within the scope of a predetermined tolerance, or respectively error range, a conforming angle has been found. If this is not the case, it is determined in step 17 that there is clearly an error, wherein the failed injector has not been recognized. In this case the method returns to step 9 and the continuous capture and storage of the amount and the angle of the harmonic of the 0.5th order of the Fourier transformed crank angle signal resumes. If in contrast a conforming angle has been detected, then the failed injector can at the same time be identified by way of the values on file in the first memory device or respectively the lookup-table. The failed injector is then output in step 19 and/or measures are taken whereby for example a warning message is issued to a driver or operator of the internal combustion engine, energizing of the failed injector is interrupted, performance of the internal combustion engine is reduced, and/or the internal combustion engine is shut off. After this, the method concludes preferably in step 21.

If an initially failed injector has been detected in step 5, because the initially captured value for the amount of the harmonic of the 0.5th order is greater than the predetermined threshold value, the method does not proceed to retrieval step 7, but rather to step 201. In this step, the number of cylinders is determined, analogously to the procedure in step 101, and the value 0 is assigned to a running variable. Reference is made in this respect to the explanations given for step 101. In both steps 201 and 101 deviating starting values for the running variable are possible. The method is then modified accordingly. In retrieval step 203 it is verified analogously to retrieval step 103 whether the running variable is smaller than the number of cylinders. This is typically the case on a first accessing of retrieval step 203, because the running variable was previously set to value 0 in step 201. In step 205 one injector to which the current value of the running variable is assigned is turned off. In regard to the assignment of the injectors to the values of the running variable we refer to the explanations already given in connection with retrieval step 103 and steps 105 to 111. Note that in step 205 only one single injector that is clearly assigned to the current value of the running variable is selectively turned off.

In a step 207 an amount and an angle of the harmonic of the 0.5th order are captured according to the operating condition of the internal combustion engine with the currently turned off injector that is assigned to the current value of the running variable. In retrieval step 209 the thus determined values for the amount and the angle which are assigned to the current value of the running variable are compared with the values that were initially determined and stored in step 3. If these values coincide, possibly within a predetermined tolerance range or respectively error range, the failed injector is the one currently turned off because no change in regard to the values that are assigned to the harmonic of the 0.5th order resulted. In this case, the method proceeds to step 19 because the initially failed injector has been recognized. The already described procedures may then be implemented and the process concludes in step 21.

If, in contrast the values that are assigned to the current value of the running variable do not coincide in retrieval step 209 with the values that were initially measured in step 3, then clearly the injector that was turned off was not the failed injector.

In this case, the injector that was turned off at the current value of the running variable is turned on again in step 211, and the count of running variable is increased by 1 in a step 213, in other words its amount is increased by 1. The process then returns to retrieval step 203 where it is again verified whether the current value of the running variable is less than the number of cylinders. A loop then occurs here which will cycle until either the initially failed injector has been identified, or until all injectors have been turned off individually, without the failed injector having been identified. Only in this last example does the running variable assumes a value which is consistent with the number of cylinders in retrieval step 203. In all other cases the loop ends earlier in retrieval step 209 because the failed injector has been identified with the process therefore moving on to step 19. Since in the last case the loop was cycled erroneously because an injector failure was detected in retrieval step 5, but thereupon no failed injector was identified, the method then reverts to step 201, where again the number of cylinders is determined. Then a new cycle of retrieval step 203 or respectively steps 205 to 209 or also 211 and 213 follows until the failed injector has successfully been identified.

Exemplary values are indicated in Table 1 which can be stored in the first memory device for identification of injectors assigned to individual cylinders. Table 1 is in this respect an example of a lookup-table. The illustrated values were measured for a 12-cylinder V-engine and in this regard represent exemplary values for entering data into a lookup-table. Table 1 is only intended to illustrate that it is in fact possible to clearly determine by way of an angle of the harmonic of the 0.5th order which injector has failed. It is evident that this angle in fact clearly indicates an individually turned off, or respectively failed injector.

In the left column of Table 1 the respective injector is clearly identified in regard to the cylinder assigned to it. In a V-engine differentiation is made between the two cylinder banks which are arranged in a geometric in V-shaped angle opposite one another and which are identified by the letters A and B. The twelve cylinders are therefore consecutively numbered with identification A1 to A6 for the cylinders of the A-bank and identification B1 to B6 for the cylinders of the B-bank. Exactly one injector is thereby allocated to each cylinder. The typical angles of the harmonic of the 0.5th order of the Fourier transformed crank angle signal are entered in the right column for the individually turned off injectors that are identified in the left column.

It is thereby shown that the individual values of the angles for the individual injectors are typical, so that these are clearly definable via the angle values.

TABLE 1

| Injector | Angle [°] |
|---|---|
| A1 | 261.6 |
| A2 | 141.7 |
| A3 | 20 |
| A4 | 200.6 |
| A5 | 319.4 |
| A6 | 81.5 |
| B1 | 216.5 |
| B2 | 96.9 |
| B3 | 334.7 |

TABLE 1-continued

| Injector | Angle [°] |
|---|---|
| B4 | 156.1 |
| B5 | 275.6 |
| B6 | 36.1 |

Overall it is shown that with the assistance of the method, the engine control unit and the system injector failure recognition is simple and quick, whereby in particular detection of defective injectors during running operation of the internal combustion engine without having to turn off the cylinder, which could disrupt operation, is possible. It is readily possible to identify a defective injector and to thereby exchange it in a targeted manner. Moreover, it is not necessary to run test sequences outside of the normal operation of the internal combustion engine, since the method facilitates virtually on-line monitoring during running engine operation.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for failure detection of injectors in an internal combustion engine, including the steps of:

measuring a crank angle signal;

transforming said crank angle signal into a frequency range using discrete Fourier-transformation;

sequentially turning off each of a number of injectors one time;

sequentially capturing and storing one time an angle of the harmonic of the 0.5th order of said Fourier-transformed crank angle signal for each said turned off injector;

continuously capturing and storing an angle and an amount of the harmonic of the 0.5th order of said Fourier-transformed crank angle signal;

continuously comparing said continuously captured amount with a predetermined threshold value and detecting an injector failure if said continuously captured amount exceeds said predetermined threshold value; and comparing said continuously captured angle with said sequentially captured angles stored for each said turned off injector, if said injector failure has been detected, and identifying said failed injector as an injector for which a stored sequentially captured angle corresponds.

2. The method according to claim 1, wherein:

said sequentially captured angles are stored in a look-up table.

3. The method according to claim 1, wherein:

said sequential capture and storing of said angles for each said turned off injector is performed after a start of the internal combustion engine or after a start of the method.

4. The method according to claim 1, wherein:

at least one action is taken when said injector failure is detected and said failed injector is identified, whereby said at least one action is selected from a group of measures consisting of issuing a warning message to a driver or operator, interrupting an energizing of said failed injector, reducing a performance of the internal combustion engine, and shutting off the internal combustion engine.

5. The method according to claim 1, wherein:

said continuously captured and stored angle and amount of the harmonic of the 0.5th order of said Fourier-transformed crank angle signal is initially stored when an initial injector failure is detected, before said angles for each said turned off injector are sequentially captured and stored one time, immediately after a start of the internal combustion engine or of the method;

after capture and initial storing of said continuously captured and stored angle and amount, said injectors are turned off sequentially one time, and for each injector an amount and an angle of the harmonic of the 0.5th order of the crank angle signal is captured and compared with said initially stored continuously captured and stored angle and amount; and a failed injector is identified by a correspondence between said amount and angle captured for said turned off injector and said initially stored continuously captured and stored angle and amount.

6. The method according to claim 5, wherein:

at least one action is taken when said injector failure is detected and said failed injector is identified, whereby said at least one action is selected from a group of measures consisting of issuing a warning message to a driver or operator, interrupting an energizing of said failed injector, reducing a performance of the internal combustion engine, and shutting off the internal combustion engine.

7. The method according to claim 1, wherein:

the method is performed by an engine control unit;

said crank angle signal is captured by a crank shaft sensor; and said engine control unit is initially synchronized to work cycles of the internal combustion engine using a cam shaft signal.

8. The method according to claim 1, wherein:

the method is performed at one operating point of the internal combustion engine under load or no-load.

9. An engine control unit for an internal combustion engine, said engine control unit implementing a series of steps, said series of steps comprising:

measuring a crank angle signal;

transforming said crank angle signal into a frequency range by way of discrete Fourier-transformation;

sequentially turning off each of a number of injectors one time;

sequentially capturing and storing one time an angle of the harmonic of the 0.5th order of said Fourier-transformed crank angle signal for each said turned off injector;

continuously capturing and storing an angle and an amount of the harmonic of the 0.5th order of said Fourier-transformed crank angle signal;

continuously comparing said continuously captured amount with a predetermined threshold value and detecting an injector failure if said continuously captured amount exceeds said predetermined threshold value; and comparing said continuously captured angle with said sequentially captured angles stored for each said turned off injector, if said injector failure has been detected, and identifying said failed injector as an injector for which a stored sequentially captured angle corresponds.

10. A system to detect injector failure in an internal combustion engine, comprising a detection device designed to capture a crank angle signal;

a converter designed to transform said crank angle signal into a frequency range by way of discrete Fourier transformation;

a switching device designed to sequentially turn off a number of injectors of the internal combustion engine;

a first memory device designed to capture and store an angle of the harmonic of the 0.5th order of said crank angle signal for each said turned off injector;

a second memory device designed to continuously capture and store an angle and an amount of the harmonic of the 0.5th order of said crank angle signal;

a first comparison device designed to continuously compare said amount stored in said second memory device with a predetermined threshold value, said first comparison device being further designed so that it detects an injector failure when said amount exceeds said predetermined threshold value;

a second comparison device designed to compare said angle stored in said second memory device with each said angle stored in said first memory device when said injector failure occurs, said second comparison device being further designed so that it identifies said failed injector as an injector for which an angle stored in said first memory device corresponds.

* * * * *